US008449266B2

(12) United States Patent
Higashidozono et al.

(10) Patent No.: US 8,449,266 B2
(45) Date of Patent: May 28, 2013

(54) CONTROL VALVE FOR VARIABLE DISPLACEMENT COMPRESSOR

(75) Inventors: Hideki Higashidozono, Tokyo (JP); Norio Uemura, Tokyo (JP); Kohei Fukudome, Tokyo (JP)

(73) Assignee: Eagle Industry Co., Ltd. (JP)

( * ) Notice: Subject to any disclaimer, the term of this patent is extended or adjusted under 35 U.S.C. 154(b) by 1005 days.

(21) Appl. No.: 12/278,101

(22) PCT Filed: Jan. 31, 2007

(86) PCT No.: PCT/JP2007/051572

§ 371 (c)(1),
(2), (4) Date: Aug. 1, 2008

(87) PCT Pub. No.: WO2007/111040

PCT Pub. Date: Oct. 4, 2007

(65) Prior Publication Data

US 2009/0035156 A1 Feb. 5, 2009

(30) Foreign Application Priority Data

Mar. 29, 2006 (JP) ..... 2006-090603

(51) Int. Cl.
*F04B 1/29* (2006.01)
*F01B 13/04* (2006.01)
*F01B 3/02* (2006.01)

(52) U.S. Cl.
USPC ..... 417/222.2; 91/483; 91/505

(58) Field of Classification Search
USPC ..... 417/222.2, 270, 222.1, 271; 91/473, 91/482, 483, 504, 505
See application file for complete search history.

(56) References Cited

U.S. PATENT DOCUMENTS 4,186,653 A 2/1980 Hobbs ..... 92/34
5,865,604 A * 2/1999 Kawaguchi et al. ..... 417/222.2

(Continued)

FOREIGN PATENT DOCUMENTS

EP 1 342 911 9/2003
JP 37-8658 7/1962

(Continued)

OTHER PUBLICATIONS

Extended European Search Report, Appln. No. 07707772.5-2315/2000720, dated Jun. 15, 2011, 6 pages.

(Continued)

*Primary Examiner* — Devon Kramer
*Assistant Examiner* — Bryan Lettman
(74) *Attorney, Agent, or Firm* — Hayes Soloway P.C.

(57) ABSTRACT

A control valve for a variable displacement compressor, in which the discharge pressure of the compressor introduced into a pressure sensing section applies urging force to a movement member, and a solenoid section applies, in cooperation with the urging force, urging force to the movement member depending on an input signal. The degree of opening of a valve body provided at the movement member is set according to the position of the movement member to regulate the rate of air flow in a communication path for interconnecting a discharge pressure region of the compressor and a compressor inner chamber. The suction pressure of the compressor is introduced into a control valve to apply urging force to the movement member, and communication between fluid having the discharge pressure introduced into the pressure sensing section and fluid having the suction pressure introduced into the control valve is shut off.

2 Claims, 3 Drawing Sheets

U.S. PATENT DOCUMENTS

| | | | | |
|---|---|---|---|---|
| 6,062,824 | A * | 5/2000 | Kimura et al. | 417/222.2 |
| 6,626,645 | B2 | 9/2003 | Okii et al. | |
| 6,772,990 | B2 * | 8/2004 | Sasaki et al. | 251/129.03 |
| 7,165,534 | B2 | 1/2007 | Usui et al. | |

FOREIGN PATENT DOCUMENTS

| | | |
|---|---|---|
| JP | 62-105464 | 7/1987 |
| JP | 2000-88125 | 3/2000 |
| JP | 2000-88129 | 3/2000 |
| JP | 2001-141086 | 5/2001 |
| JP | 2003-254191 | 9/2003 |
| JP | 2003-322086 | 11/2003 |

OTHER PUBLICATIONS

Chinese Office Action, Appln. 2007800020338, dated Jan. 15, 2010, 2 pages.
Japanese Official Action dated Sep. 6, 2011 and translation (4 pgs).
Final Office Action issued in U.S. Appl. No. 12/278,067 dated Nov. 10, 2011 (11 pgs).
U.S. Office Action, U.S. Appl. No. 12/278,067, dated May 26, 2011, 10 pages.

* cited by examiner

CONTROL VALVE FOR VARIABLE DISPLACEMENT COMPRESSOR

TECHNICAL FIELD

The present invention relates to a control valve for a variable displacement compressor provided with a pressure sensing section, a solenoid section, and a valve section composed of a valve element that is provided to a movement member, wherein the internal pressure of the compressor is adjusted by the degree of opening of the valve element, and the discharge displacement is varied.

BACKGROUND ART

A control valve for a variable displacement compressor that is used to compress the refrigerant of an automobile air conditioning device is known as an example of a control valve having a pressure sensing section that applies an urging force to a movement member according to a pressure introduced to the pressure sensing section, wherein the movement member is moved by the urging force to adjust the degree of valve opening (see Patent Document 1). This control valve uses a bellows assembly in the pressure sensing section, and FIG. 5 is a schematic sectional view showing this type of control valve for a variable displacement compressor.

As shown in FIG. 5, the control valve 1 is composed of a solenoid section 2, a valve section 3, and a bellows assembly 4. The solenoid section 2 is disposed at one end of a cylindrical valve body 5, magnetic force is generated by applying an electrical current to a coil 6, a movable iron core 7 is moved against a spring 8 toward a fixed iron core 9 disposed to the left, and an urging force proportional to the square of the current value is applied to a valve rod 10. A port 11 communicated with the region of the discharge pressure Pd of the variable displacement compressor, and a port 12 communicated with an inner chamber (chamber pressure Pc) of the variable displacement compressor, are formed in the valve body 5; and the valve section 3 is configured so as to be capable of adjusting the rate of flow of discharged refrigerant gas into the inside of the compressor on the basis of the degree of opening of a valve element 13 formed at an end of the valve rod 10 with respect to a valve seat 14.

At the other end of the valve body 5 from the solenoid section 2, the bellows assembly 4 is provided to a pressure sensing chamber 16 composed of a case 15 and the valve body 5, and suction pressure Ps of the compressor acts on the pressure sensing chamber 16. The bellows assembly 4 has a bellows 19 that is retained at both ends by holders 17, 18 so as to be able to expand and contract, a spring 20 extends between the holders, and a connecting rod 21 in contact with and connected to both members is disposed between the holder 18 and the left end 10*a* of the valve rod 10. Consequently, the bellows 19 is expanded and contracted by the change in the suction pressure Ps introduced to the pressure sensing chamber 16, the urging force applied to the valve rod 10 changes, and the degree of valve opening is made variable.

The balance of forces acting on the valve rod 10 when the control valve 1 thus configured is open is indicated by the equation $Ps=(F1+F2-F)/A$, wherein F1 is the urging force of the spring 20, F2 is the urging force of the spring 8, F is the solenoid thrust, and A is the effective pressure surface area of the bellows. As is also apparent from this equation, since the suction pressure Ps achieves balance at a low value when the solenoid thrust F is increased, and the suction pressure Ps achieves balance at a high value when the solenoid thrust is reduced, the control valve is highly useful as a control valve for a variable displacement compressor used to compress the refrigerant of an air conditioning device.

Patent Document 1: Japanese Laid-open Patent Application No. 2001-141086 (paragraphs 0015 through 0018, and FIGS. 1 and 4)

DISCLOSURE OF THE INVENTION

[Problems to be Solved by the Invention]

However, the control valve 1 in Patent Document 1 is configured so that the suction pressure Ps acts on the bellows 19 provided to the pressure sensing chamber 16 while, on the other hand, the discharge pressure Pd is introduced from the port 11 of the valve body 5 adjacent to the pressure sensing chamber 16, and the communication between the pressure sensing chamber 16 and the port 11 is nearly blocked by the connecting rod 21. However, the blockage is not necessarily complete, and the refrigerant gas moves from the gap between the connecting rod 21 and the valve body 5 and leaks from the discharge pressure Pd side to the suction pressure Ps side, resulting in reduced efficiency. In order to avoid this problem, a ring seal may be used in the connecting rod 21 to block communication between the pressure sensing chamber 16 and the port 11. However, sliding resistance created by the ring seal is applied as the connecting rod 21 moves in conjunction with the movement of the movement member, the valve opening position cannot be reliably attained by the movement member, and the correct suction pressure that corresponds to the solenoid thrust is difficult to maintain.

The present invention was developed in view of such drawbacks, and an object of the present invention is to provide a control valve for a variable displacement compressor whereby sliding resistance that accompanies valve movement can be reduced as much as possible, the rate of air flow can be stably and accurately adjusted, and the correct suction pressure that corresponds to solenoid thrust can be maintained.

[Means for Solving These Problems]

The control valve for a variable displacement compressor according to a first aspect of the present invention for solving the abovementioned problems is a valve comprising a pressure sensing section, a solenoid section, and a valve section composed of a valve element that is provided to a movement member, wherein an internal pressure of the compressor is adjusted by a degree of opening of the valve element, and a discharge displacement is varied; the control valve for a variable displacement compressor being characterized in that a discharge pressure of the compressor introduced to the pressure sensing section applies an urging force to the movement member; the solenoid section applies, in cooperation with the urging force, an urging force to the movement member in accordance with an input signal; a degree of opening of the valve element is set in accordance with a position of the movement member; a rate of air flow of a communicating channel for communicating a compressor inner chamber with a discharge pressure region of the compressor is adjusted; a suction pressure of the compressor is introduced to the control valve to apply an urging force to the movement member; and communication between a fluid having the discharge pressure introduced to the pressure sensing section, and a fluid having the suction pressure introduced to the control valve, is blocked by contact of the movement member and an expanding and contracting member constituting the pressure sensing section.

According to this aspect of the present invention, communication between the fluid having the discharge pressure of the compressor that is introduced to the pressure sensing section, and the fluid having the suction pressure of the compressor that is introduced to the control valve, is blocked without the use of a seal member or the like by contact of the movement member and an expanding and contracting member constituting the pressure sensing section. Sliding resistance that accompanies movement of the movement member can therefore be eliminated, the flow rate of air via the communicating channel can be stably and accurately adjusted, and the movement member can be prevented from moving in the valve closing direction in response to an increase in discharge pressure when the control valve is not performing control.

The control valve for a variable displacement compressor according to a second aspect of the present invention is the control valve for a variable displacement compressor according to the first aspect, characterized in that a sealed chamber acted on by the suction pressure of the compressor is formed in a portion of contact between the expanding and contracting member and the movement member.

According to this aspect, forming a sealed chamber acted on by the suction pressure of the compressor in the portion of contact between the expanding and contracting member and the movement member makes it possible to maintain seal properties during control as well as valve opening retention properties during non-control through the use of an extremely simple control valve structure.

KEY TO SYMBOLS

Figure 1:
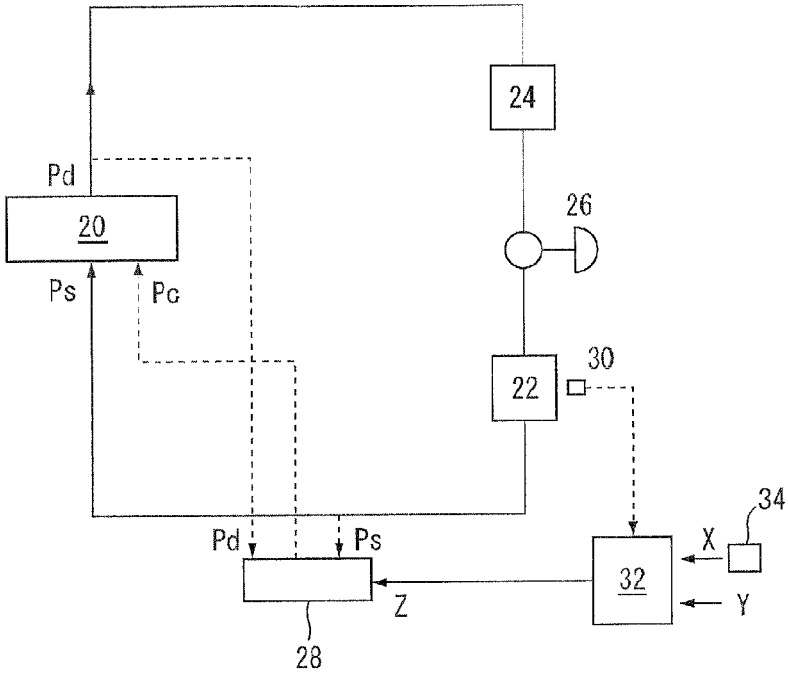
FIG. 1 is a control flowchart showing the cooling cycle of the variable displacement compressor in an example of the present invention.

20 variable displacement compressor
22 evaporator
24 condenser
26 expansion valve
28 control valve
30 temperature sensor
32 control device
34 temperature setting device
36 solenoid section
38 valve section
40 pressure sensing section
42 valve body
44 coil
46 movable iron core
48 spring
49 fixed iron core
50 valve rod (movement member)
50*a* communicating hole
52, 54 ports
56 valve element
58 valve seat
60 case
62 pressure sensing chamber
64 bellows assembly (expanding and contracting member)
66, 68 holders
70 bellows
72 spring
74 cap element
76 suction chamber
77 seal ring
78 sealed chamber
Ps suction pressure
Pd discharge pressure
Pc compressor chamber pressure

BEST MODE FOR CARRYING OUT THE INVENTION

Examples of the present invention will be described hereinafter.

EXAMPLES

Figure 2:
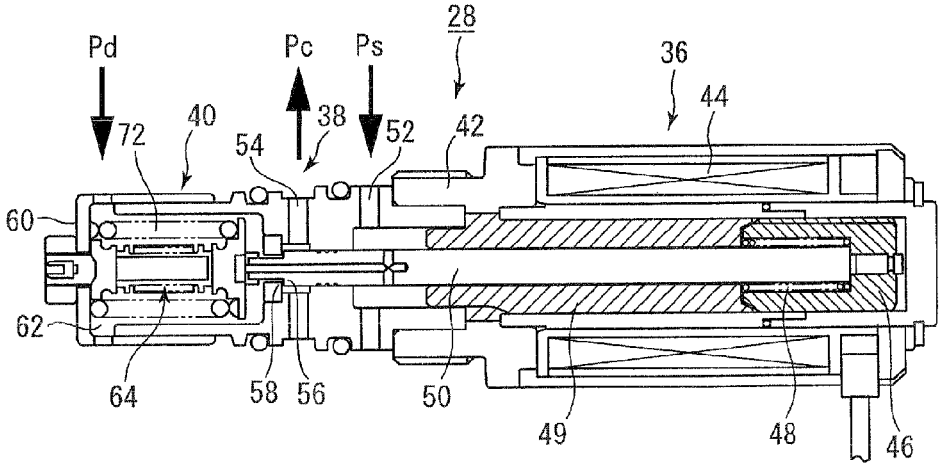
FIG. 2 is a sectional view showing the control valve used in FIG. 1.
Figure 3:
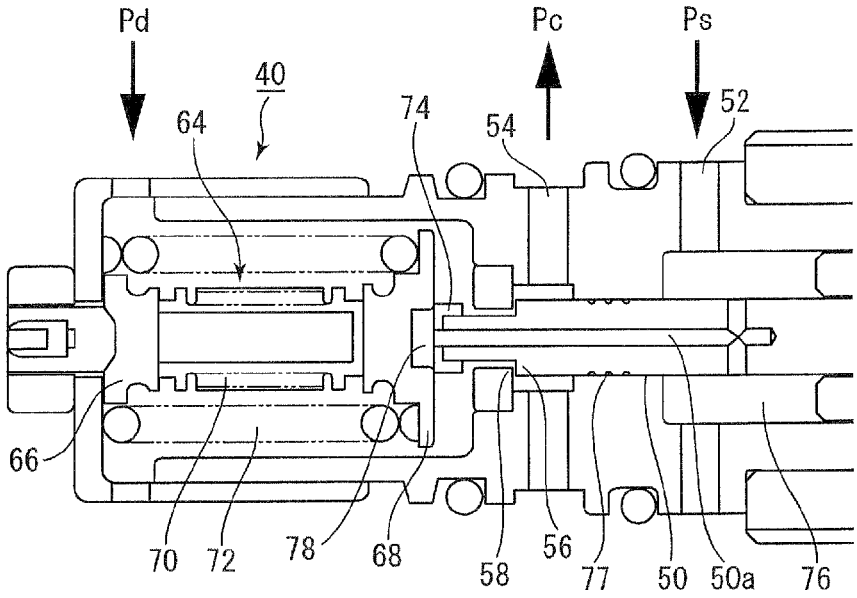
FIG. 3 is an enlarged sectional view showing the pressure sensing chamber.
Figure 4:
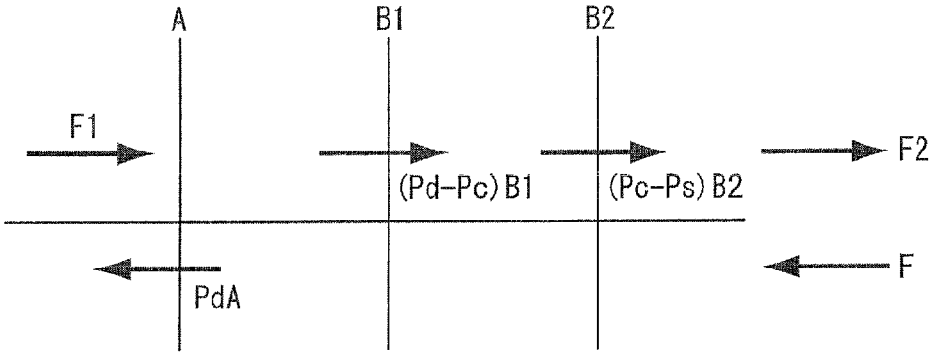
FIG. 4 is a schematic view showing the state of balance of urging forces applied to the valve rod.
Figure 5:
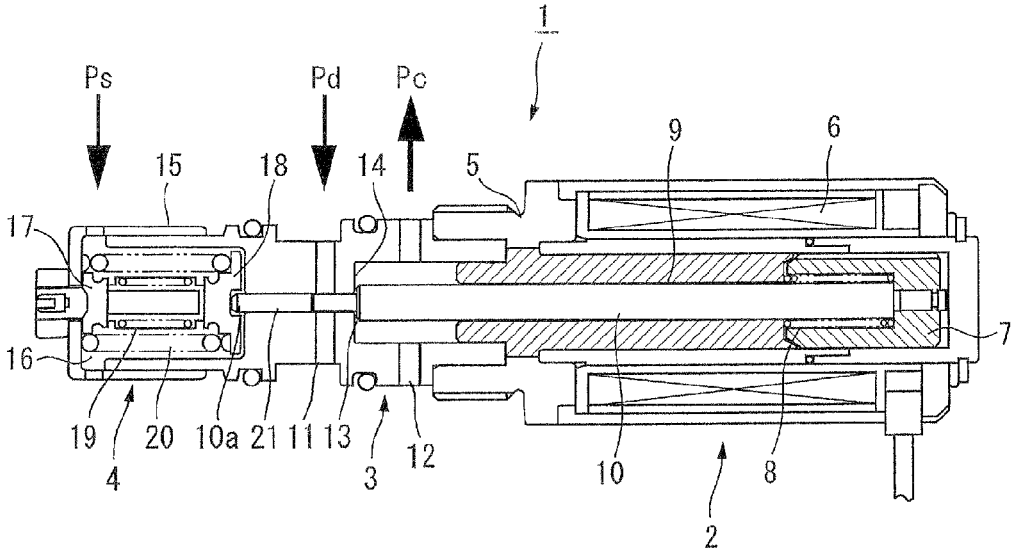
Fig. 5 PRIOR ART
FIG. 5 is a schematic sectional view showing the conventional control valve for a variable displacement compressor.

FIG. 1 is a control flowchart showing the cooling cycle of the variable displacement compressor in an example of the present invention; FIG. 2 is a sectional view showing the control valve for a variable displacement compressor used in FIG. 1; FIG. 3 is an enlarged sectional view showing the pressure sensing chamber; and FIG. 4 is a schematic view showing the state of balance of urging forces applied to the valve rod.

The control valve for a variable displacement compressor according to the present invention is used to control the output of a variable displacement compressor used to compress the refrigerant of a car air conditioner or other automobile air conditioning device, for example, and the functions in the refrigeration cycle of this control valve will be described based on FIG. 1. The refrigeration cycle shown in FIG. 1 is a publicly known cycle in which a refrigerant gas at a suction pressure Ps drawn in from an evaporator 22 by a variable displacement compressor 20 is compressed to a high discharge pressure Pd, and the compressed refrigerant gas is converted to a liquid refrigerant by a condenser 24, after which the liquid refrigerant is vaporized in a single cycle by an expansion valve 26 and directed into the evaporator 22, and then drawn in again by the variable displacement compressor 20 after the inside of the car is cooled by latent heat of evaporation. A control valve 28 is configured so as to control the discharge displacement of the variable displacement compressor 20 in accordance with the cooling load.

As shown in FIG. 1, a temperature sensor 30 is disposed in the vicinity of the evaporator 22, and temperature information of the evaporator 22 is sent as an input signal to a control device 32. Vehicle interior temperature information Y or setting information X from a temperature setting device 34 for specifying the temperature of the vehicle cabin is inputted as an input signal to the control device 32, and an output signal Z having the optimum value based on the input signals is computed and outputted to the control valve 28.

A portion (discharge pressure region) of the refrigerant gas at the discharge pressure Pd discharged from the variable displacement compressor 20 passes through the control valve 28 and flows into the inside chamber of the variable displacement compressor 20. The operation of the control valve 28 will be described in detail hereinafter. When the output signal Z is received, the degree of opening of the control valve 28 varies according to the size of the signal, and the flow rate of refrigerant gas that flows into the inside chamber (crank case chamber) of the variable displacement compressor 20 is adjusted by the degree of valve opening.

A variable rotary swash plate compressor, for example, in which the discharge capacity can be varied according to the size of the pressure Pc of the inside chamber, is used as the variable displacement compressor 20. Although not shown in the drawing, the chamber pressure of the variable displacement compressor 20 is communicated with the suction side of the compressor via an aperture or other limiting device, and when the degree of opening of the control valve 28 is large and the flow rate of refrigerant gas increases, the chamber pressure Pc in a state substantially equal to the suction pressure Ps increases, the swash plate stands up, and the discharge quantity of the compressor decreases. On the other hand, when the degree of opening of the control valve 28 is small, the chamber pressure Pc decreases, the swash plate is tilted, and the discharge quantity of the compressor increases. The configuration in which the discharge quantity is varied by the change in chamber pressure Pc of the variable displacement compressor is not limited to one in which the chamber pressure of the compressor is communicated with the suction side of the compressor via a limiting device, as described above, and the conventional, publicly known displacement variation-type compressor disclosed in Japanese Laid-open Patent Application No. 63-16177, for example, may also be used.

The specific structure and operation of the control valve 28 will next be described using FIGS. 2 and 3. The control valve 28 is composed of a solenoid section 36, a valve section 38, and a pressure sensing section 40. The solenoid section 36 is disposed at one end of a cylindrical valve body 42. The output signal Z from the control device 32 is converted to an electrical current value and fed to a coil 44, whereby magnetic force is generated, a movable iron core 46 is moved against a spring 48 toward a fixed iron core 49 disposed to the left in the drawing, and an urging force proportional to the square of the current value is applied to a valve rod 50.

According to the pressure of the refrigerant gas at the discharge pressure Pd introduced to the pressure sensing chamber 62, the bellows 70 expands and contracts, the urging force applied to the valve rod 50 changes, and the degree of valve opening becomes variable. The flow rate of the refrigerant gas of the pressure sensing chamber 62 that flows into the inside chamber of the compressor 20 via the port 54 is adjusted based on the degree of opening of the valve element 56 with respect to the valve seat 58.

At the other end on the side opposite the solenoid section 36 of the valve body 42 that constitutes the pressure sensing section 40, a bellows assembly 64 (expanding and contracting member) is provided to a pressure sensing chamber 62 composed of a case 60 and the valve body 42, and the discharge pressure Pd of the compressor acts on the pressure sensing chamber 62. As shown in FIG. 3, the bellows assembly 64 has a bellows 70 that is retained at both ends by holders 66, 68 so as to be able to expand (*1) and contract, and a spring 72 extends between the holders 66, 68. A cap element 74 capable of elastic deformation is fitted on the left end of the valve rod 50, and is always in contact with the holder 68.

Since the spring 72 is disposed on the external peripheral part of the bellows assembly 64, even when the bellows 70 is subjected to an uneven sideways force during expansion and contraction, the uneven sideways force is suppressed by the spring 72, and the thrust that occurs in the bellows assembly 64 due to the discharge pressure Pd can therefore be stably transmitted to the valve rod 50.

A port 52 for communicating with the suction pressure Ps of the variable displacement compressor 20, a port 54 for communicating with the inside pressure (chamber pressure Pc) of the variable displacement compressor 20 are formed in the valve body 42, and the valve section 38 is configured so that the flow rate of discharged refrigerant gas into the inside chamber of the compressor 20 an be adjusted based on the degree of opening with respect to the valve seat 58 of a valve element 56 formed in the end part of the valve rod 50 that acts as the movement member.

The refrigerant gas having the suction pressure Ps is introduced into a suction chamber 76 that is communicated with the port 52, and is communicated via a communicating hole 50*a* formed in the valve rod 50 with a sealed chamber 78 that is formed by the cap element 74 and the right end part of the holder 68. A seal ring 77 fitted on the external peripheral part of the valve rod 50 blocks communication between the suction chamber 76 and the space on the side of the port 54 on which the chamber pressure Pc acts.

In the balance of forces acting on the valve rod 50 when the control valve 28 configured as described above is open, the urging force of the spring 72 is designated as F1, the urging force of the spring 48 as F2, the solenoid thrust as F, and the effective pressure surface area of the bellows as A. The right-directed forces applied to the valve rod 50 as shown in FIG. 4 are the urging force F1 of the spring 72, the urging force F2 of the spring 48, the force (Pd−Pc)B1 applied to the valve rod 50 and based on the pressure difference between the discharge pressure Pd and the chamber pressure Pc (wherein B1 is the effective pressure surface area of the valve element 56), and the force (Pc−Ps)B2 applied to the valve rod 50 and based on the pressure difference between the chamber pressure Pc and the suction pressure Ps (wherein B2 is the effective pressure surface area of the seal ring 77 fitted on the outside diameter of the valve rod). The left-directed forces applied to the valve rod 50 are the force PdA applied by the discharge pressure Pd to the bellows assembly, and the solenoid thrust F. Therefore, $F1+F2+(Pd-Pc)B1+(Pc-Ps)B2=PdA+F$, and $Ps=(F1+F2-F)/A$ when B1 and B2 are designed to be substantially the same size as A.

As is also apparent from this equation that since the suction pressure Ps achieves balance at a low value when the solenoid thrust F is increased, and the suction pressure Ps achieves balance at a high value when the solenoid thrust F is decreased, the control valve is suitable as a control valve for a variable displacement compressor used to compress the refrigerant of an air conditioning device.

Specifically, in adjusting the cooling capability of the variable displacement compressor, when the value of the temperature information Y for the inside of the vehicle cabin exceeds the value of the setting information X of the temperature setting device 34, an electric current corresponding to the differential of $Y-X=Z$ is additionally fed to the coil 44 of the solenoid section 36 from the control device 32, the movable iron core 46 is drawn towards the fixed iron core 49 against the urging force of the spring 48, and this thrust acts as an urging force that urges the valve rod 50 to the left. The urging force acts on the valve rod 50 so that the valve element 56 moves toward the valve seat 58 so that the valve is closed, the flow of refrigerant gas from the discharge region of the variable displacement compressor 20 into the inside chamber of the compressor is reduced, and the chamber pressure Pc decreases.

When the chamber pressure Pc of the compressor decreases, the swash plate tilts so as to cause the discharge quantity of the compressor 20 to increase, the discharge pressure Pd increases and the suction pressure Ps decreases, and the valve rod 50 is retained in the valve opening position at which the thrust applied by the solenoid section 36 is balanced by the reduced suction pressure Ps, as is also apparent from the aforementioned balance equation. Consequently, the optimum suction pressure Ps that corresponds to the output signal Z from the control device 32 is obtained, and the temperature inside the vehicle cabin can be reduced to the set temperature.

In the present invention, since the discharged refrigerant gas of the compressor introduced into the pressure sensing section and the suctioned refrigerant gas of the compressor introduced to the control valve are blocked from communication with each other by the holder 68 and the cap element 74, the valve rod 50 can move smoothly without sliding resistance, and the flow rate of refrigerant gas through the communicating channel can be stably and accurately adjusted. In a non-controlled state in which the valve is normally completely open, the discharge pressure Pd is high, and the bellows 70 sometimes contracts even in the non-controlled state during summer and other times. In this case, however, a valve-open state can be maintained by opening the sealed chamber 78 and temporarily communicating the suction pressure side via the communicating hole 50*a* formed in the valve rod 50. Through the use of a simple control valve structure in which the communicating hole 50*a* is formed in the valve rod 50 to communicate with the sealed chamber 78, the seal properties of the sealed chamber can be maintained during control, and the valve-open state can be maintained during non-control.

An example of the present invention was described above using the accompanying drawings, but the specific configuration of the present invention is not limited by the example, and various modifications or additions are possible within the intention and scope of the present invention. For example, in the example described above, the control valve was used to control the output of a variable displacement compressor for compressing a refrigerant, but the refrigerant gas is not limiting, and the present invention may also be applied to other common liquids.

The invention claimed is:

1. A control valve for a variable displacement compressor comprising;

a valve body having a solenoid section disposed at one end of the valve body in which is formed a first port for communicating with a suction pressure of the variable displacement compressor, and a second port for communicating with an internal pressure of a compressor inner chamber of the variable displacement compressor;

a pressure sensing section disposed at an other end on a side opposite the solenoid section of the valve body comprising a bellows assembly which is disposed in a pressure sensing chamber composed of a case and the valve body, wherein the bellows assembly has a bellows that is retained at both ends by holders with a spring positioned between the holders allowing the bellows to expand and contract; and a valve section having a valve element, disposed at one end of a valve rod which has a communicating hole communicating with a suction chamber, wherein the internal pressure of the compressor inner chamber is adjusted by a degree of opening of the valve element with respect to a valve seat, and a variable displacement is varied;

a discharge pressure of the compressor introduced to said pressure sensing chamber causing said bellows assembly to expand and contract, and applying a first urging force to said valve rod;

wherein the solenoid section applies, in cooperation with the first urging force, a second urging force to said valve rod in accordance with an input signal;

the degree of opening of the valve element being set in accordance with a position of said valve rod, and a rate of flow of a communicating channel for communicating the compressor inner chamber with a discharge pressure region of the compressor being adjusted; and communication between a fluid having said discharge pressure introduced to said pressure sensing chamber, and a fluid having said suction pressure introduced to said communicating hole of said valve rod being blocked by a continuous stationary contact of a cap element capable of elastic deformation which is fitted on an end of a holder side of the valve rod and a valve rod side holder.

2. The control valve for said variable displacement compressor according to claim 1, wherein, a sealed chamber acted on by the suction pressure of said compressor is formed in a portion of contact between the valve rod side holder of the bellows assembly and the cap element fitted on the valve rod.

* * * * *